US006814167B2

(12) United States Patent
Weixler

(10) Patent No.: US 6,814,167 B2
(45) Date of Patent: Nov. 9, 2004

(54) BORING DEVICE AND BORING METHOD

(75) Inventor: Leonhard Weixler, Thierhaupten (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 22 days.

(21) Appl. No.: 10/281,283

(22) Filed: Oct. 28, 2002

(65) Prior Publication Data

US 2003/0094308 A1 May 22, 2003

(30) Foreign Application Priority Data

Nov. 9, 2001 (DE) ..... 101 55 105

(51) Int. Cl.[7] ..... E21B 43/00; E21B 7/128; E21B 7/20; E21B 19/18

(52) U.S. Cl. ..... 175/57; 166/77.51; 166/85.5; 166/250.16; 166/358; 175/7; 175/23; 175/216; 175/403

(58) Field of Search ..... 166/250.16, 77.1, 166/77.51, 85.1, 85.5, 78.1, 242.1, 358; 175/5, 7, 19, 22, 23, 57, 162, 263, 267, 216, 257, 703, 404

(56) References Cited

U.S. PATENT DOCUMENTS

| | | | | | |
|---|---|---|---|---|---|
| 2,716,018 | A | * | 8/1955 | Williams | 175/98 |
| 3,552,506 | A | * | 1/1971 | Mayer | 175/85 |
| 3,675,727 | A | * | 7/1972 | Clark | 175/26 |
| 4,126,193 | A | * | 11/1978 | Brown et al. | 175/171 |
| 4,147,215 | A | * | 4/1979 | Hodge et al. | 166/380 |
| 4,433,943 | A | * | 2/1984 | Pao Chen | 405/241 |
| 4,577,693 | A | * | 3/1986 | Graser | 166/338 |
| 5,251,709 | A | * | 10/1993 | Richardson | 175/220 |
| 5,327,980 | A | * | 7/1994 | Smet | 175/21 |
| 5,396,964 | A | * | 3/1995 | Shellhorn et al. | 175/195 |
| 5,653,556 | A | | 8/1997 | White | |
| 5,857,530 | A | * | 1/1999 | Gronseth | 175/45 |
| 6,663,321 | B1 | * | 12/2003 | Bisschops | 405/232 |

FOREIGN PATENT DOCUMENTS

| | | | | |
|---|---|---|---|---|
| DE | 2734185 C2 | | 2/1983 | E21B/43/10 |
| DE | 3920392 A1 | | 1/1991 | E21C/50/00 |
| DE | 197 29 315 A1 | | 1/1999 | E21B/7/02 |
| EP | 1 310 600 A1 | | 5/2003 | |
| FR | 1509586 | | 1/1968 | |
| GB | 2231601 | * | 11/1990 | E02F/3/88 |
| NL | 7313707 | | 10/1973 | E21B/7/02 |

OTHER PUBLICATIONS

Dr.–Ing. Erich Bieske, *Handbuch de Brunnenbaus*, vol. I. Berlin, pp. 88–89 (1956).

* cited by examiner

*Primary Examiner*—David Bagnell
*Assistant Examiner*—Jennifer H Gay
(74) *Attorney, Agent, or Firm*—Jacobson Holman PLLC

(57) ABSTRACT

A boring device for producing a bore with a casing tube has a linkage, a boring tool, which can be fixed to the lower end of the linkage, a mounting frame for mounting on the casing tube, a drive and a connecting device, which is used for producing a rotary connection between the casing tube and the mounting frame. The linkage is hollow and has a first and a second flushing line. In the vicinity of the upper end of the link-age are provided a first connection for the supply of a fluid to the first flushing line and a second connection for removing the borings via the second flushing line. A boring method introduced the casing tube into the soil prior to an excavation.

13 Claims, 4 Drawing Sheets

4
5
14
10
28
20
26
22
24
12
44
44
19
18
46
3
7

BORING DEVICE AND BORING METHOD

BACKGROUND OF THE INVENTION (1) Field of the Invention

The invention relates to a boring device and a boring method for producing a bore and having a support pipe, which is introduced into the soil.

(2) Description of Related Art

A relevant prior art is known from document DE-C-27 34 185. An internal boring device is inserted by a crane into a casing tube arranged in the ground. This known boring device has a cylindrical casing in which the motor for the rotary motion is placed. The boring device is connected to the inner surface of the casing tube by means of clamping device nearby the bottom of the bore hole.

Another method for making a bore hole with a casing tube is known from the document FR-A-15 09 586. A boring auger together with a cylindrical receiving container for receiving the borings are arranged on a linkage. During the boring the borings are conveyed into the receiving container. If it is completely filled, the receiving container and the boring auger are retracted. The receiving container can be released and axially moved away from the boring auger. The drive for the boring auger is arranged on a carriage being movably mounted on a mast.

In the document "Handbuch des Brunnenbaus", vol. 1, pages 88 and 89, of Bieske, Berlin 1956, a boring method without using any casing tube is described. For removing the borings from the bore hole flushing lines are used.

When producing foundation piles for building foundations, it is known to initially introduce into the soil a support pipe, e.g. using rams or a vibrating pile hammer. The soil within the support pipe can then be removed by means of a boring device. This is particularly appropriate with relatively loose soil, because the support pipe prevents the giving way of the bore walls.

For removing the soil within a support pipe use is normally made of a soil auger, whose external diameter is matched to the internal diameter of the support pipe. When using a soil auger it is necessary to use a special boring device with a vertical mast, on which the soil auger is vertically displaceable guided and simultaneously retained so as to be rotatable. As the vertical mast, which is normally fitted to a movable mount, can only be tilted by a few degrees, the use of a soil auger in uneven ground or terrain with considerable level differences is problematical. It may be necessary in such a case to initially create a horizontal platform on the support pipe for the boring device with the soil auger.

Moreover, the boring device with a soil auger cannot be used or at best can only be used after protracted equipment modifications for the preceding introduction of the support pipe into the ground.

BRIEF SUMMARY OF THE INVENTION

Therefore the object of the invention is to provide a boring device and a boring method, which permit an efficient production of a bore with a casing tube.

This object is achieved by a boring device and a boring method in accordance with the invention.

The boring device according to the invention is provided with a linkage with a crane attachment at its upper end, a boring tool, which can be fixed to the lower end of the linkage, a mounting frame in which the linkage is held in rotary and axially displaceable manner and which is constructed for mounting on the casing tube, a drive, which is located on the mounting frame and constructed for the rotary driving of the linkage and a connecting device for producing a firm connection between the casing tube and the mounting frame, in which the linkage is hollow and has a first flushing line and a second flushing line and in the vicinity of the upper end of the linkage are provided a first connection for the supply of a fluid to the first flushing line and also a second connection, which is constructed for removing the borings by means of the second flushing line.

The boring device according to the invention can be used hung on a crane, so that considerable terrain unevennesses or greater level differences between the casing tube and the boring device have no influence on the performance of the boring method. In particular, the boring device hung on a crane cable is vertically oriented in automatic manner, so that there is no need for complicated adjustments for vertical boring purposes.

For effective boring the boring device linkage is constructed in hollow manner and provided with at least two fluid lines. The first fluid line can be used for transporting the borings or mud from the boring tool. The other line is used for supplying a fluid. The fluid can be water or air in order to assist the transporting away of the borings. However, the flushing line can also be used for the supply of a suspension which will harden, so that on extracting the boring device from the bore, the latter can be filled with hardenable suspension, particularly concrete. In order to ensure a reliable torque transmission to the boring tool despite the crane suspension, the boring device according to the invention is mounted with a mounting frame on the upper edge of the casing tube and detachably fixed thereto by means of a connecting device. The connecting device permits a rapid release of the rotary connection, which together with the continuous suspension of the boring device on the crane permits an efficient continuous production of bores.

The connecting device can comprise different positive or non-positive locking devices. According to the invention it is preferable for the connecting device to have hydraulic holding clamps, with which the mounting frame can be clamped to an upper edge of the casing tube. Hydraulically operable clamps permit a rapid clamping and release in the case of high clamping forces.

According to another preferred embodiment of the invention, the first or second connection can have a swivel joint. Thus, the flushing lines rotating with the linkage can be reliably connected to stationary devices, particularly fluid reservoirs located outside the bore. Such a swivel joint generally comprises two rotary flanges rotatable relative to one another and arranged in liquid-tight manner, whereof one is connected to the flushing line and the other to the stationary line.

The most varied devices can be used as boring tools, e.g. a boring bucket. According to the invention it is particularly advantageous for the boring tool to be a full cut boring head and for the boring string to have a hollow construction with two lines, which are connectable with the first flushing line and the second flushing line in the linkage. Such a full cut boring head is particularly suitable for working a hard substrate, e.g. rock. Combined with the removal of the borings by means of the flushing line, it is also possible to make a very deep bore. It is possible to fit to the boring device according to the invention various boring tools, so that for each soil layer to be bored the most suitable boring tool can be used.

According to the invention the boring device is hung by means of a cable on a crane jib and a first hauling cable is fixed to the side facing the jib, whilst extending towards the latter and that on the other side is articulated a second hauling cable, which extends to the upper end of the jib. The boring device hung on a crane jib can consequently be subject to the action of hauling cables and winches from two opposite sides. This makes it possible to prevent any undesired swinging of the boring device and the latter can be easily swung to the side of the crane jib and held in this swung out position. In such a swung out position it is e.g. possible to use the crane by means of a second cable winch for positioning and bringing in the support pipe, without it being necessary to detach the boring device from the crane.

There is at least one flushing line in the hollow linkage. According to the invention the linkage can be constructed as a double-wall linkage, the annular hollow space between an inner core and the outer linkage wall forming the flushing line. The other flushing line can be located on the outside or in a radial internal hollow space of the inner linkage.

The boring method according to the invention is characterized in that use is made of the boring device described hereinbefore and said boring device is hung on a cable of a crane. This makes it possible to efficiently produce a bore with the advantages described hereinbefore.

A preferred embodiment of the method according to the invention comprises producing a first bore within the casing tube, that a boring head with boring string is introduced separately from the boring device into the casing tube and that finally the boring device is firmly connected by means of the linkage to the boring string.

It is possible to make the first bore with a different boring tool, such as a boring bucket or soil auger. The boring tool can be fitted to the boring device according to the invention and used with the latter for making the first bore, e.g. in a looser substrate. Thus, in the support pipe is formed a free space, which can be used for introducing and adjusting a boring head with boring string. This permits using different boring tools to bring about an efficient penetration rate, a full cut boring head with boring string being particularly appropriate for working a hard substrate.

According to the invention, said method is further developed in that the boring head with the boring string is held by means of a holding device in the support pipe in a connection position prior to fixing to the linkage, that following fixing the holding device is released, whilst the boring device continues to be suspended on the cable, and that finally the mounting frame is connected to rotate with the support pipe. This permits a reliable and at the same time rapid connection of the boring string of the boring head to the boring device linkage.

A particularly efficient fixing of the boring string within the support pipe for connection to the linkage is inventively brought about in that the holding device has at least one carriage with a holding fork displaceable radially to the support pipe and in which rests in the holding position a flange of the boring string. In particular, there are two, three or four holding forks uniformly distributed round the circumference of the upper end of the support pipe on a platform. The holding fork width corresponds to the external diameter of the boring string and the larger diameter flange or collar of the boring string rests on the holding fork or forks and consequently in a desired holding position. This permits an easy connection to the boring device linkage outside the support pipe.

In the case of the crane according to the invention, it is advantageously provided that the bore is made with the boring device through the support pipe into an underlying soil layer. It is possible to drive a support pipe into a relatively loose soil. However, if a foundation pile extended beyond the looser soil layer is necessary, initially the looser soil layer within the support pipe can be removed by a first boring tool, e.g. a boring bucket. It is possible to fix and use a second boring tool, particularly a full cut boring head with boring string to the same boring device and it is then possible therewith to remove in an efficient manner a more solid, rocky soil located below the support pipe.

The pressure on the boring tool can be applied by means of a telescopic linkage via corresponding hydraulic pressure cylinders. However, it is particularly effective and energy-saving that during boring the linkage is guided in axially freely displaceable manner in the mounting frame, so that the weight of the linkage presses on the boring tool. The boring string can additionally be provided with loading weights, so that an adequate pressure can be exerted on the boring tool for a speedy penetration rate.

A preferred embodiment of the boring method according to the invention comprises, during boring, flushing air being supplied by means of the first flushing line, whereas via the second flushing line borings can be removed with liquid and flushing or scavenging air. This method permits a particularly efficient transporting away of borings, so that there is a speedy penetration rate.

The invention is described in greater detail hereinafter relative to preferred embodiments and the attached diagrammatic drawings, wherein show:

DETAILED DESCRIPTION OF THE INVENTION

Figure 1:
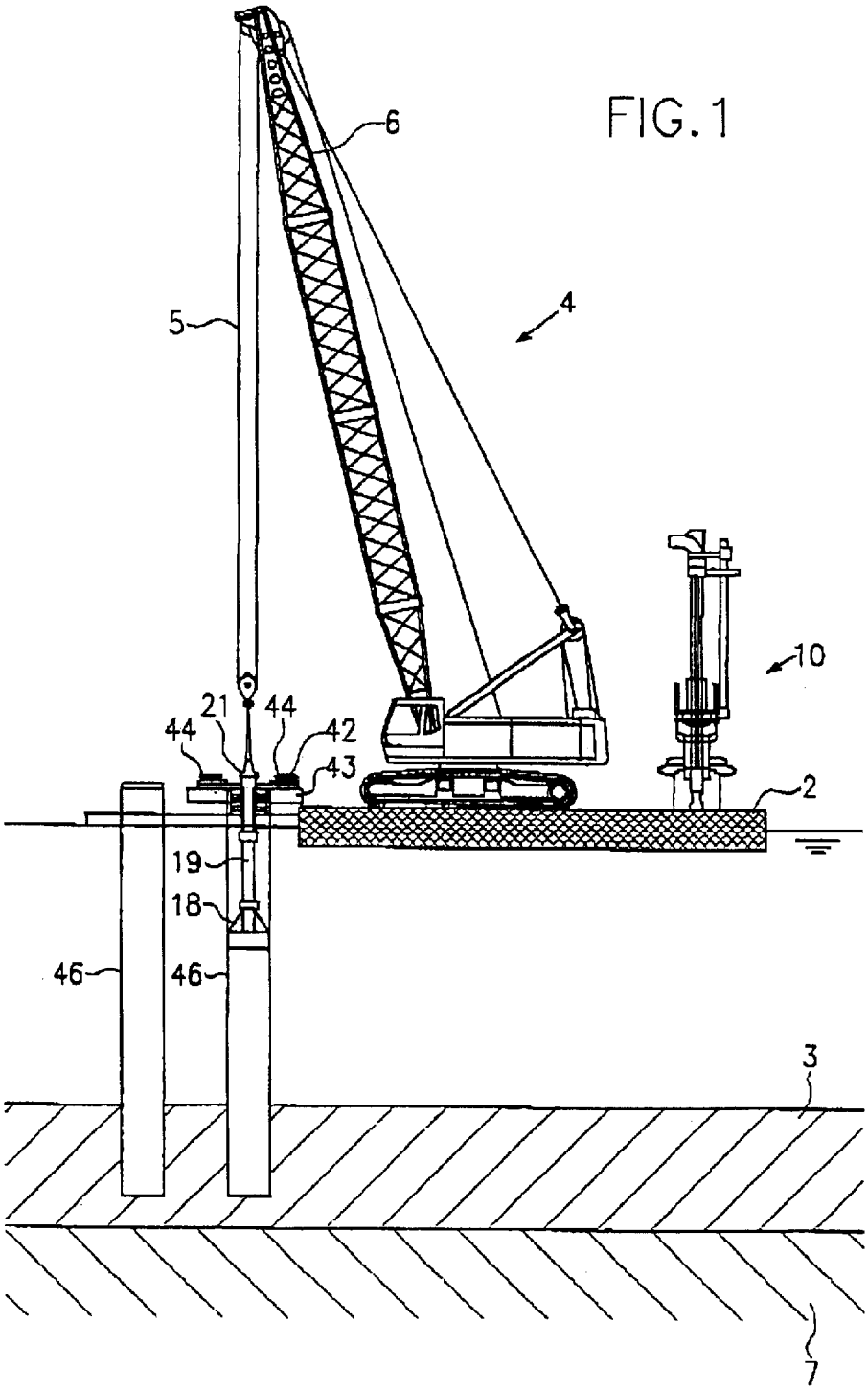
FIG. 1 is a side elevational view, partially in cross-section, illustrating the introduction of a boring tool into a support pipe.

According to FIG. 1 a crane 4 with a jib 6 is located on a floating pontoon 2. For producing foundation piles two support pipes 46 have already been driven into a looser soil layer 3 on the bed of the watercourse. In a first casing tube 46, which extends beyond the surface of the water, with the crane 4 and using a cable 5 a boring tool is inserted in the casing tube 46. The boring tool, which comprises a full cut boring head 18 with a tubular boring string 19, is lowered by means of the cable 5 to a clearly defined height of a larger diameter collar 21 on the boring string 19.

The boring tool is fixed in this position by means of a holding device 42. For this purpose two facing carriages 44, which are displaceably mounted on a circular platform 43 at the upper end of the casing tube 46, are radially infed to the boring string 19. Not shown holding forks come to rest below the larger diameter collar 21, so that the latter rests on the holding forks of the two carriages 44 in the holding position.

Figure 2:
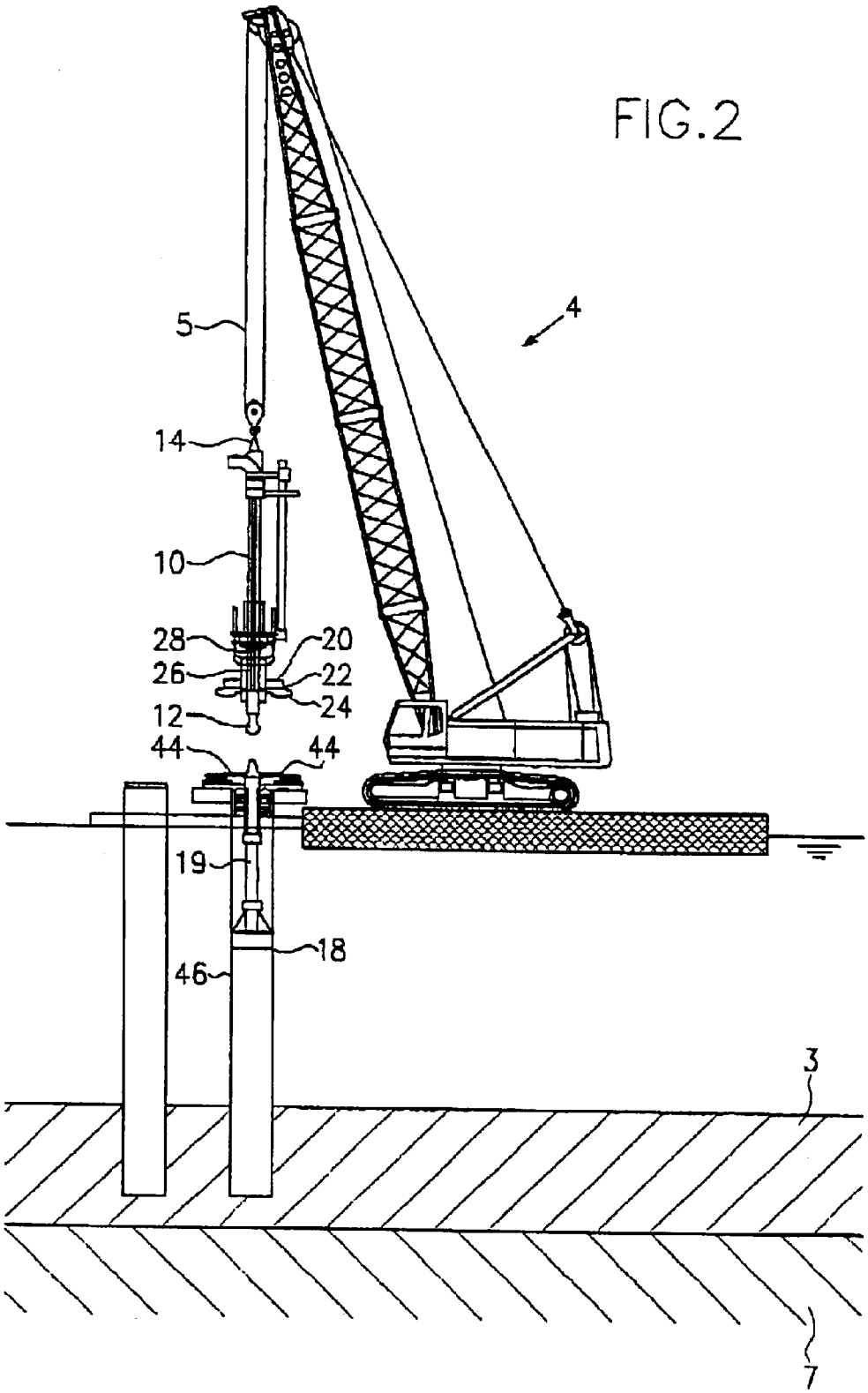
FIG. 2 is a side elevational view, partially in cross-section, illustrating the application of the boring device to the boring tool.

The cable 5 is now released from the boring tool and the crane 4 can take up the boring device 10 supplied on the pontoon 2. The boring device 10 is oriented by means of the crane 4 over the boring tool fixed in the casing tube 46 and as shown in FIG. 2. Then the boring device 10 located on the cable 5 on a crane attachment 14 is lowered onto the upper end of the boring string 19 and connected to rotate therewith. Optionally between the boring device 10 and the boring string 19 can be used further boring string elements in order to achieve a desired boring depth.

For connecting a linkage 12 of the boring device 10 so as to rotate with the boring string 19, diagrammatically represented flushing lines 26, 28 are connected to corresponding lines within the boring string 19.

The two carriages 44 of the holding device 42 are removed radially from the boring string 19, the boring device 10 being further lowered by means of the cable 5 until a mounting frame 20 of the boring device 10 rests on the upper edge of the support pipe 46. Holding clamps 24 of a connecting device 22 engage around the edge of the support pipe 46 and clamp the mounting frame 20 to said pipe 46.

The boring head 18 is now deposited on the surface of the looser soil layer 3 by the axial displacement of the linkage 12 of the boring device 10 through the lowering of the cable 5.

Figure 3:
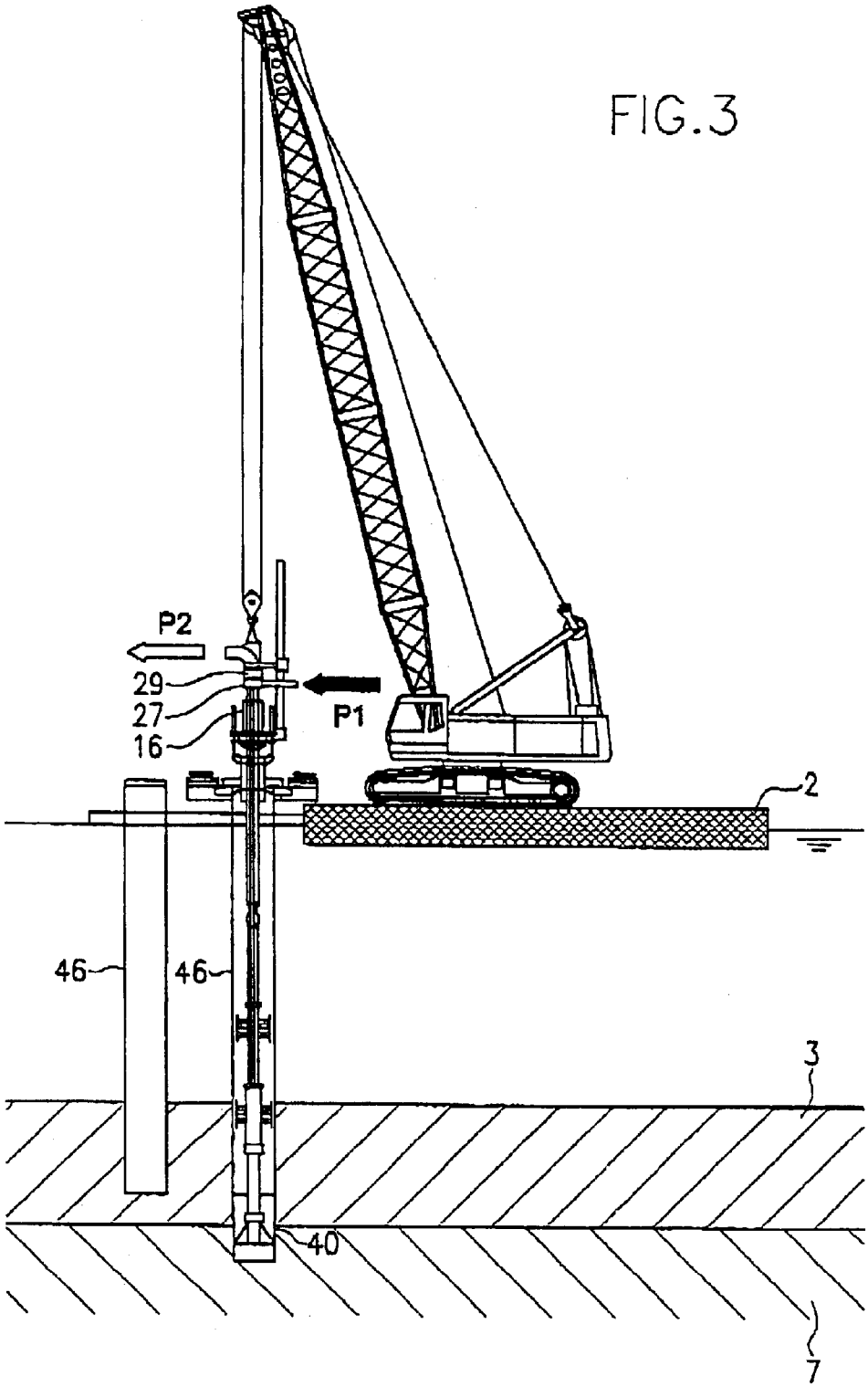
FIG. 3 is a side elevational view, partially in cross-section, illustrating the boring device according to the invention when making a bore.

The boring head 18 with boring string 19 is now rotated by means of a hydraulic drive 16 located on the mounting frame 20 and the boring head 18, in accordance with FIG. 3, removes soil 3 within the support pipe 46 and by further lowering makes a bore 40 down into the rocky soil layer 7.

In accordance with the arrow P1, air is blown by means of a first connection 27 into the first flushing line, the scavenging air discharging into the second flushing line 28 borings removed from the bore 40 by the boring head. By means of a second connection 29, the borings are removed in accordance with the arrow P2 at the upper end of the boring device 10.

When making the bore, it can be provided with concrete and optionally steel reinforcements for forming a foundation pile. The boring device 10 can be conveyed by means of the crane 4 in simple manner to the next support pipe 46, without there being any need for complicated modification and readjustment of the pontoon 2.

Figure 4:
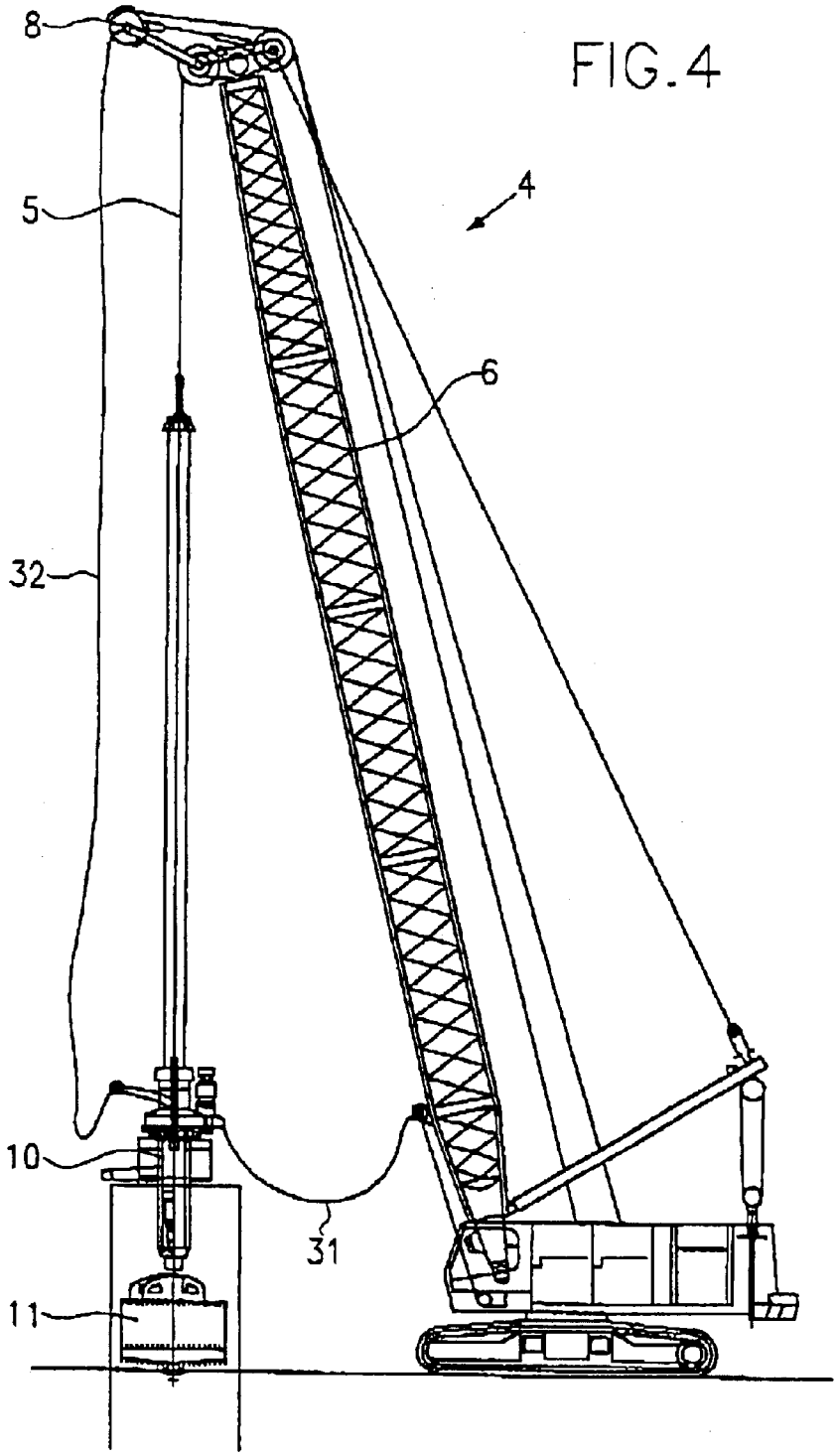
FIG. 4 is a diagrammatic side elevational view of another boring device according to the invention, which is hung on a crane.

In the further embodiment of the invention according to FIG. 4, a boring device 10 provided with a boring bucket 11 as the boring tool, is suspended in the above-described manner by means of a cable 5 on a jib 6 of a crane 4. To prevent undesired swinging of the boring device 10 and so as to permit a swinging aside of the boring device 10 on the jib 6, between said device 10 and the jib 6 is provided a first hauling cable 31. The latter can be tightened by means of a not shown winch for swinging aside purposes. A second hauling cable 32 is articulated to the side of the boring device 10 remote from the jib 6. The second hauling cable 32 extends from the boring device 10 to the jib point 8. The latter is provided with a guide pulley, which extends by a clearly defined amount away from the jib 6 beyond the cable 5. Through corresponding tensioning of the second hauling cable 32 and the first hauling cable 31, it is possible to counteract an undesired swinging movement of the boring device 10.

What is claimed is:

1. Boring device for producing a bore with a casing tube, which is introduced into the soil, having a linkage with a crane attachment on its upper end, a boring tool, which is arranged at a lower end of the linkage, a mounting frame, in which the linkage is held in rotary and axially displaceable manner and which is constructed for mounting on the casing tube, a drive located on the mounting frame and constructed for the rotary driving of the linkage and a connecting device for making a torque strength connection between the casing tube and the mounting frame, wherein the linkage is hollow and has a first flushing line and a second flushing line and in the vicinity of the upper end of the linkage are provided a first connection for supplying a fluid to the first flushing line are provided and a second connection constructed for removing the borings via the second flushing line.

2. Boring device according to claim 1, wherein the connecting device has hydraulic holding clamps with which the mounting frame can be clamped to a upper edge of the casing tube.

3. Boring device according to claim 1, wherein at least one of the first connection and the second connection has a swivel joint.

4. Boring device according to claim 1, wherein the boring tool is a full cut boring head with boring string and the boring string is hollow and has two lines connectable to the first flushing line and the second flushing line in the linkage.

5. Boring device according to claim 1, wherein to the boring device can be suspended by means of a cable on a jib of a crane; a first hauling cable, which extends up the jib, is fixed to the boring device on the side of the boring device facing the jib and a second hauling cable, which extends to the upper end of the jib, is articulated on the other side of the boring device.

6. Boring device according to claim 1, wherein the linkage is constructed as a double-wall linkage.

7. Boring method using a boring device suspended on a cable of a crane on a casing tube, the boring device being provided with:

a linkage with a crane attachment on its upper end, a boring tool, which is arranged at a lower end of the linkage, a mounting frame, in which the linkage is held in rotary and axially displaceable manner and which is constructed for mounting on the casing tube, a drive located on the mounting frame and constructed for the rotary driving of the linkage and a connecting device for making a torque strength connection between the casing tube and the mounting frame, wherein the linkage is hollow and has a first flushing line and a second flushing line and in the vicinity of the upper end of the linkage a first connection for supplying a fluid to the first flushing line and a second connection constructed for removing the borings via the second flushing line, are provided wherein the method comprises the steps of:

introducing a casing tube in soil, placing a boring device, on the casing tube, fastening the mounting frame to the casing tube by means of the connecting device, and boring the ground, while introducing a fluid by the first flushing line and removing the borings by the second flushing line.

8. Boring method according to claim 7, wherein the bore with the boring device is deposited through the casing tube in an underlying soil layer.

9. Boring method according to claim 7, wherein during boring, the linkage is guided in axially freely displaceable manner in the mounting frame, so that the weight of the linkage presses on the boring tool.

10. Boring method according to claim 7, wherein during boring, scavenging air is supplied by means of the first flushing line, whilst the second flushing line removes borings with liquid and scavenging air.

11. Boring method using a boring device suspended on a cable of a crane on a casing tube, the boring device being provided with:

a linkage with a crane attachment on its upper end, a boring tool, which is arranged at a lower end of the linkage, a mounting frame, in which the linkage is held in rotary and axially displaceable manner and which is constructed for mounting on the casing tube, a drive located on the mounting frame and constructed for the rotary driving of the linkage and a connecting device for making a torque strength connection between the casing tube and the mounting frame, wherein the linkage is hollow and has a first flushing line and a second flushing line and in the vicinity of the upper end of the linkage a first connection for supplying a fluid to the first flushing line and a second connection constructed for removing the borings via the second flushing line, are provided wherein the method comprises the steps of:

introducing a casing tube in soil, placing a boring device, fastening the mounting frame to the casing tube by means of the connecting device, and boring the around, while introducing a fluid by the first flushing line and removing the borings by the second flushing line, wherein a first bore is produced within the casing tube, a boring head with boring string, separate from the boring device, is used in the casing tube and then the boring device is firmly connected by means of the linkage to the boring string.

12. Boring method according to claim 11, wherein the boring head with boring string, prior to fixing to the linkage, is held by means of a holding device in the casing tube in a connecting position, after fixing, the holding device is released, whilst the boring device is still suspended on the cable and the mounting frame is then firmly connected with the casing tube for a torque strength arrangement.

13. Boring method according to claim 12, wherein the holding device has at least one carriage with a holding fork displaceable radially to the casing tube in which rests a flange of the boring string in the holding position.

* * * * *